US006695160B1

(12) United States Patent
Culley et al.

(10) Patent No.: US 6,695,160 B1
(45) Date of Patent: Feb. 24, 2004

(54) TOP LOAD SEAL PROTECTION FEATURE

(75) Inventors: Brian K. Culley, Mt. Vernon, IN (US); C. Edward Luker, Evansville, IN (US); Gary V. Montgomery, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 7 days.

(21) Appl. No.: 09/943,153

(22) Filed: Aug. 30, 2001

(51) Int. Cl.[7] ..... B65D 41/04

(52) U.S. Cl. ..... 215/329; 215/341; 215/44; 215/45; 215/330; 220/288

(58) Field of Search ..... 215/329, 44, 45, 215/42, 341, 330; 220/288, 296, 295; 411/412, 413, 436

(56) References Cited

U.S. PATENT DOCUMENTS

| | | | | | |
|---|---|---|---|---|---|
| 174,638 | A | | 3/1876 | Otterson | |
| 2,111,499 | A | * | 3/1938 | Welhart | 215/42 |
| 3,010,596 | A | | 11/1961 | Williams et al. | |
| 3,297,213 | A | | 1/1967 | Henderson | |
| 3,435,978 | A | | 4/1969 | Wittwer | |
| 3,487,442 | A | | 12/1969 | Rossmann | |
| 3,682,345 | A | * | 8/1972 | Baugh | 215/330 |
| 3,690,496 | A | | 9/1972 | Gibson | |
| 3,734,332 | A | | 5/1973 | Grulich | |
| 3,785,539 | A | | 1/1974 | Wetterek | |
| 4,193,509 | A | * | 3/1980 | Dunn et al. | 215/330 |
| 4,299,330 | A | * | 11/1981 | Walter | 220/288 |
| 4,349,116 | A | * | 9/1982 | Luenser | 215/330 |
| 4,415,095 | A | | 11/1983 | Schweigert et al. | |
| 4,416,373 | A | | 11/1983 | deLarosiere | |
| 4,512,493 | A | | 4/1985 | Von Holdt | |
| 5,197,621 | A | | 3/1993 | Bartl et al. | |
| 5,292,020 | A | | 3/1994 | Narin | |
| 5,560,504 | A | | 10/1996 | Molinaro | |
| 5,722,545 | A | | 3/1998 | Rinne | |
| 5,788,101 | A | | 8/1998 | King | |
| 5,803,281 | A | | 9/1998 | Towns | |
| 5,803,287 | A | | 9/1998 | Kusz | |
| 5,884,790 | A | * | 3/1999 | Seidita | 215/330 |
| 5,913,434 | A | | 6/1999 | Kukuhara et al. | |
| 6,105,802 | A | * | 8/2000 | French et al. | 215/318 |
| 2002/0158037 | A1 | * | 10/2002 | Kano et al. | 215/341 |
| 2002/0166834 | A1 | * | 11/2002 | Branson et al. | |

* cited by examiner

*Primary Examiner*—Robin A. Hylton
(74) *Attorney, Agent, or Firm*—James E. Cole; John F. Salazar; Middleton Reutlinger

(57) ABSTRACT

A container finish comprising a helical load carrying member which transmits downward force from the top wall of a closure to the threads of a container to prevent seal failure under stacking load conditions. The helical load carrying member is preferably located on a container neck, parallel to a primary thread. In the alternative the helical load carrying member may be located on a closure finish.

9 Claims, 4 Drawing Sheets

TOP LOAD SEAL PROTECTION FEATURE

BACKGROUND OF THE INVENTION

1. Technical Field of the Invention

The present invention relates generally to a top load seal protection feature. More particularly, the present invention relates to a load bearing thread which transmits stacking load from the top wall of a closure to the threads of a container in order to prevent seal failure under stacking load conditions.

2. Description of the Related Art

When manufacturers mass-produce containers and closures containing food, drink, and the like, the containers are usually shipped to distributors and vendors for public consumption. In order to prepare the containers for shipping, the containers are often stacked in a vertical manner and placed in boxes or crates in a space saving configuration. Throughout shipping and storage of the containers, they remain in this vertical configuration for various periods of time. The extended storage times often result in large vertical loads being placed on the container closures, which may not be factored into their design. As a result of the stacking, large loads may cause sealing gaskets located within the closures to rupture in turn causing leakage, spoilage, or destruction of the food product.

Current container closure designs generally suffer from an array of disadvantages, such as those described above, which detract from their efficiency and use. For example, U.S. Pat. No. 4,512,493 to Von Holdt discloses a molded bucket having high stack strength. This design suffers from at least two disadvantages. First, a sealing gasket located preferably on the lid at shelf to seal contents of a bucket would be exposed to the vertical loading attributable to bucket and any other vertically stacked buckets. This design would likely cause a gasket to rupture. Second, this design forces a user to push a closure (lid) onto a container (bucket) therefore eliminating its use as a screw-type closure.

Various inventions use a container with a single thread and a small pitch to bear a stacking load. However there are various disadvantages inherent with these structures. First, a container or closure having a small pitch necessarily has a small target area for engagably starting the closure threads on the container threads. Second, machines used for installation of screw on closures often turn closures at a rate of about 500 RPM. This speed in combination with a small target area can lead to manufacturing difficulties and stripped threads. Third, a process comprising pushing a closure onto a container, instead of screwing on a closure may lead to problems like stripped threads and uncertainty as to the orientation of closure threads relative to container threads.

In view of the deficiencies in the known container threads and closures it is apparent that a container is needed having top load seal protection characteristics as well as having a closure which is easy to install. It is also preferable that the closure be both closable and openable with a single turn.

SUMMARY OF THE INVENTION

It is an object of the present invention to provide a top load seal protection feature.

It is a further objective of this invention to provide a load bearing thread operably engaged with a container thread to divert a top load to a container.

It is still a further objective of this invention to divert a top load to a load bearing thread of a container and away from a sealing gasket located in a closure crown.

It is still an even further objective of the present invention to have the above stated characteristics and yet have a closure which is operable with a single rotation.

It is an even further objective of this invention to force the closure to move immediately upward when the cap is unscrewed and prevent cocking such that the closure and bottle maintain axial alignment in spite of the large clearance between threads.

More particularly, the present invention provides a container finish comprising an upstanding neck portion, a primary thread helically extending around the upstanding neck portion, a load bearing thread spaced below the primary thread and helically extending around the upstanding neck portion. The load bearing thread preferably starts at a point below a starting point for the primary thread and the load bearing thread is connected to the primary thread by a connecting thread portion. The connecting thread portion is preferably a horizontal thread portion extending from the primary thread. The geometry of the threads is such that the vertical distance in the target area for starting the closure is about twice the vertical distance between the primary thread and the load bearing thread.

In an alternative embodiment, the present invention provides a closure finish, comprising a top wall and a skirt depending therefrom, the skirt having a closure thread and a load bearing thread in a spaced helical relationship on an interior surface of the skirt, where the load bearing thread has a starting point or transition area above or below the closure thread at some location along the skirt and may connect to the closure thread by a connecting portion. The vertical distance in the target area of the closure threads is preferably about twice a vertical distance between said closure thread and said load bearing thread.

In yet another alternative embodiment the load bearing closure comprises a top wall having an annular skirt depending therefrom, a helically circumscribing thread along an inner surface of the skirt, at least one load bearing protuberance equidistantly spaced and integral with an inner surface of the annular skirt, and each of the at least one of the load bearing protuberances and the helically circumscribing thread forming a groove therebetween for operably receiving a container thread. There are preferably three load bearing protuberances which are preferably spaced about 120 degrees apart.

All of the above outlined objectives are to be understood as exemplary only and many more objectives of the invention may be gleaned from the disclosure herein. Therefore, no limiting interpretation of the objectives noted is to be understood without further reading of the entire specification and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
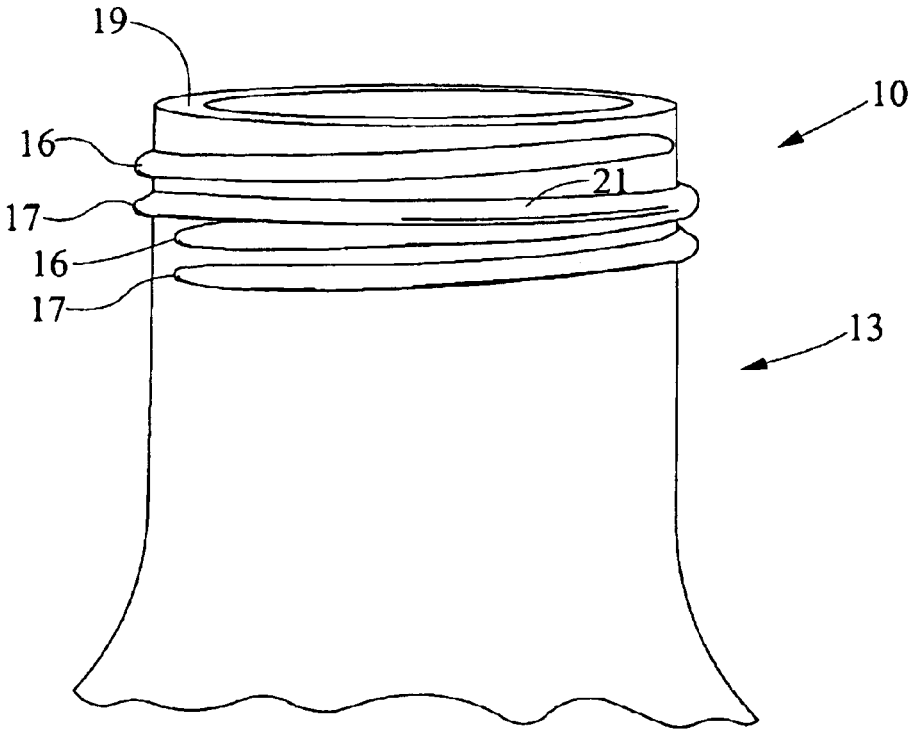
FIG. 1 is a perspective view of a preferred top load seal protection feature of the present invention.

The present invention will now be described in conjunction with the drawings, referring initially to FIGS. 1 and 2, which show a top load seal protection feature of the present invention. Generally indicated as reference 10, the present invention comprises threads formed on a container or closure which remove downward force from the top gasket or seal and transfer it to the container. The closure and container using the designs of the present invention can be made of various materials such as plastics including polyethylene, polypropylene, metal and glass combinations, or other materials, alone or in combination.

Figure 2:
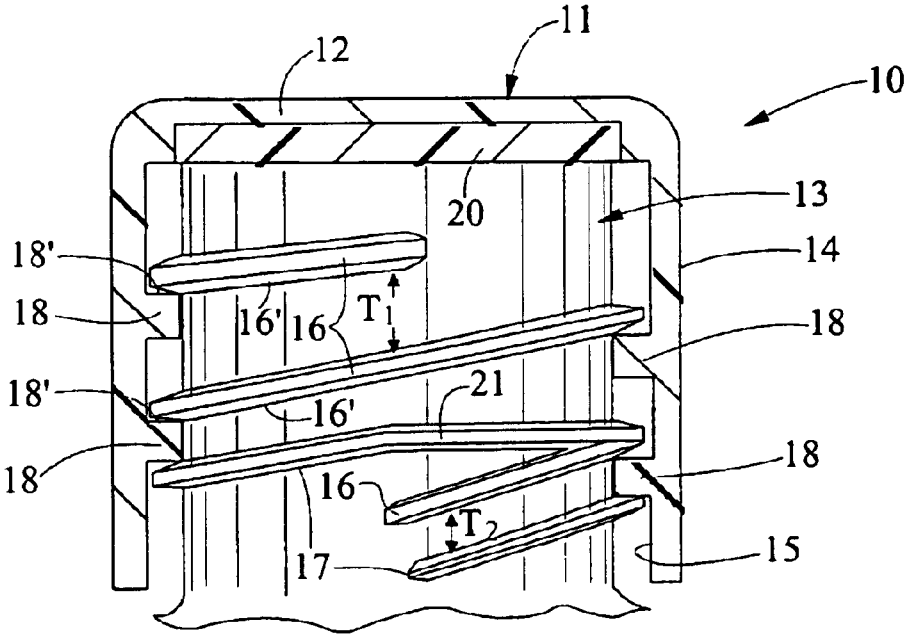
FIG. 2 is a sectional view of a preferred top load seal protection of the present invention.

Closure 11 of FIG. 2 may be preferably injection molded but can be formed by various methods and has an overall cup like shape. Most preferably the closure top wall 12 has a generally circular shape. Depending from the top wall 12 is a skirt 14. The outer surface of the skirt 14 may be knurled or have vertical ridges for aid in gripping and applying torque to the closure 11. Circumscribing the inner surface of the skirt are helical closure threads 18. The closure threads 18 are for operably engaging primary thread 16 located on the container 13 and allow multiple openings and closings of the container 13 after its initial opening.

Located within an inner side of closure top wall 12 may be a gasket 20 for sealing the contents of the container 13. The gasket 20 is preferably made of soft plastic, rubber-like or foam material which forms to the upper lip 19 of container 13. The gasket 20 seals contents from escaping between the container 13 and the closure 11. In addition the gasket 20 may prevent air and other contaminants from entering the container 13 which may cause the contents to spoil.

During shipping and storage of the containers 13 multiple containers are often stacked in a vertical configuration. A typical result of this stacking is that the gasket 20 is ruptured or otherwise damaged by the upper lip 19 of the container 13 due the top load. However, the present invention overcomes that problem through the use of a load bearing thread 17.

The load bearing thread 17 preferably starts from some point along a primary or container thread 16 so that a user can place the closure 11 on the container 13, rotate the closure 11, and easily "start" the closure on the container even though a second thread is provided. Near the top of the container 13, only a primary thread 16 is needed having a large target area, "$T_1$", to easily start the closure 11 onto container 13 in between the consecutive helical rotations of the primary thread 16. The load bearing thread 17 starts as a connecting thread or a horizontal thread portion 21 from the primary thread 16 and may have the same pitch as the primary thread 16. The load bearing thread 17 runs parallel and below the primary thread 16 as it extends around the container neck 13. As also shown in FIG. 2, the load bearing thread 17 and parallel primary thread 16 receive closure thread 18 therebetween. Without the load bearing thread 17, one can see that thread 18 could move downward if a downward force is placed on the closure 11. However, with the arrangement of the present embodiment the isolation of the closure thread sections 18 between primary thread 16 and load bearing thread 17 prevents movement of the closure relative to the container 13 thus preventing gasket 20 from being damaged by the top load. In other words, downward force is transmitted to the load bearing thread 17 and on to container 13. To facilitate the most efficient transfer of top load to the container 13, closure thread 18 may operably have at least one flat load transfer surface 21.

In the present embodiment and as exemplary only, the geometric relationship between the primary thread pitch "$T_1$" and vertical distance "$T_2$" should be maintained. "$T_1$" is the thread pitch of the primary thread, that is the distance between adjacent peaks of the primary thread 16. "$T_2$" is the distance between the primary thread 16 and the load bearing thread 17. Vertical distance "$T_1$" may be about twice the vertical differential "$T_2$". Because "$T_1$" is larger than "$T_2$" it forms a target area, the area for starting a closure thread 18 on the container neck 13. Also, if the pitch of the primary thread 16 and load bearing thread 17 are equal then vertical differential "$T_2$" will not vary and the closure thread 18 will be properly isolated therebetween. Preferably distance "$T_2$" is about 1/16 of an inch (1.5875 mm) and "$T_1$" is about 1/8 of an inch (3.175 mm), however these measurements will vary if the pitch of the thread is varied. Preferably, the pitch is about six threads per inch. With this pitch, the closure can be removed in preferably one rotation. However, if the relationship between "$T_1$" and "$T_2$" varies, the closure thread 18 may not fit between primary thread 16 and load bearing thread 17, or closure thread 18 may be loose and therefore allow gasket 20 to be damaged.

Connecting thread portion 21 is also shown in FIG. 2 connecting the primary thread 16 and load bearing thread 17. The connecting thread portion 21 is molded integral with the primary thread 16 and load bearing thread 17. Connecting thread portion 21 starts from below the starting point of the primary thread 16 and extends horizontally around container neck 13 until load bearing thread 17 begins. From that point load bearing thread 17 extends helically around container neck 13 parallel and equidistant to primary thread 16.

For use of the present invention, the helical thread 18 of the closure enters target area "$T_1$" and continues along the helix moving above the connecting thread 21. More specifically, an upper surface 18' of helical thread 18 contacts a lower surface 16' of primary thread 16 and the lower surface of helical thread 18 may contact connecting thread 21. As the closure 11 rotates, helical thread 18 next enters a space between load bearing thread 17 and primary thread 16. At that point, load bearing thread 17 contacts helical thread 18 on a bottom surface of the helical thread 18 while the top surface of helical thread 18 remains in contact with the lower surface of primary thread 16. The closure is rotatably closed until the closure is sealed and secured to the container.

Figure 3:
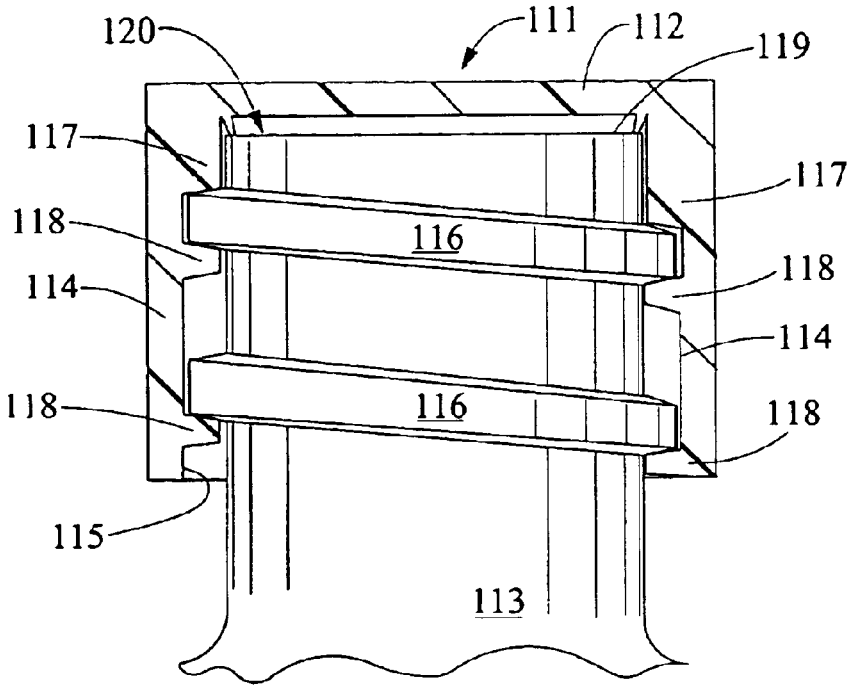
FIG. 3 is a sectional view of an alternative embodiment of the top load seal protection feature of the present invention.

FIG. 3 shows the present inventive combination wherein the load bearing thread 117 is located on the closure 111 instead of the container 113. A closure 111 is shown having top wall 112 generally of circular shape. Depending from the top wall 112 is a skirt 114 and load bearing thread 117. Located on an interior surface 115 of the skirt 114 is a primary thread 118 for rotatably engaging a container thread 116. Also located on the interior surface 115 of skirt 114 is a load bearing thread 117 which extends from container thread 116 near the top wall 112 of the closure 111.

Load bearing thread 117 works with primary thread 118 to isolate container thread 116 of the container 113. By isolating container thread 116 between load bearing thread 117 and closure thread 118, the top load stacking force is transmitted through the closure 111, to load bearing thread 117, and to the container 113 efficiently without harming gasket 120.

The vertical distance of the target area between closure threads 118 is about twice the vertical differential between load bearing thread 117 and closure thread 118. This allows for a larger target area in which to start the closure. The load bearing thread 117 may preferentially be parallel to the closure thread 118 and preferably originates from a point beneath the starting point of the closure thread 118. This ensures that there is no "play" between the container thread 116 and threads 117 and 118 and maintains a damage free the gasket 120.

Figure 4:
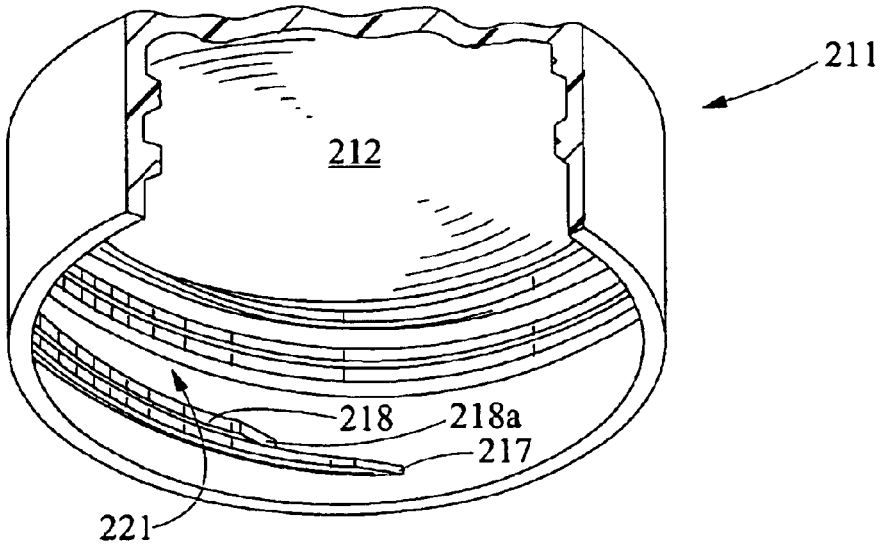
FIG. 4 is a lower perspective view of an alternative embodiment of the present invention having a continuous load bearing thread.
Figure 5:
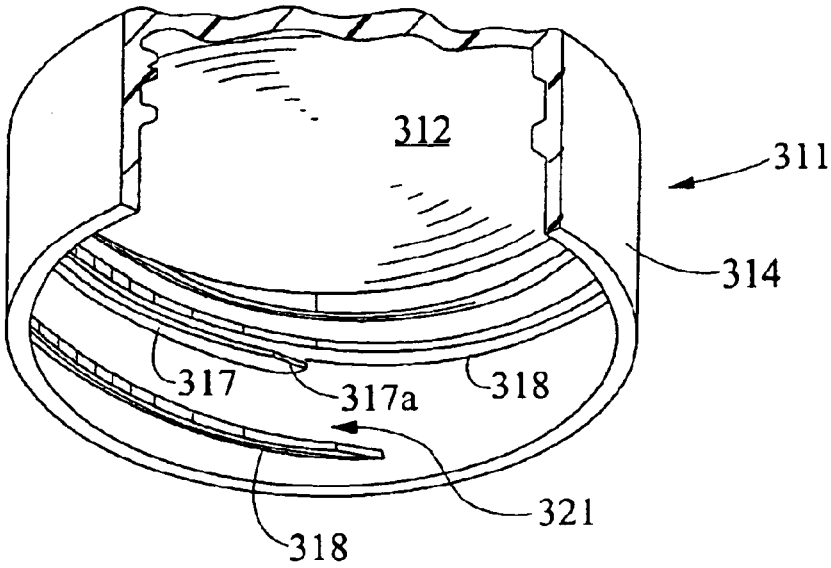
FIG. 5 is a lower perspective view of an alternative embodiment of the present invention having a load bearing thread on top of a primary thread.

FIGS. 4 and 5 show two different embodiments of the load bearing thread being used on the closure. In FIG. 4 the closure thread 218 is shown having a transition area 218*a*, the area where closure thread 218 begins, above the closure thread 218 and near the open end of the closure 211. Since closure thread 218 does not extend as far as the load bearing thread 217 this allows a larger target area when the closure 211 is initially rotated onto a container. Space or groove 221 between successive rotations of load bearing thread 217 and closure thread 218 provides an area for a container thread to pass. As a closure thread enters the groove 221, load bearing thread 217 transfers any stacking load from the closure 211 to a container through thread 217 thereby maintaining seal integrity.

FIG. 5 shows how the transition area 317*a* for load bearing thread 317 also can be manufactured below the closure thread 318 but has a starting point near the middle of skirt 314. The load bearing thread 317 has a transition area 317*a* below the closure thread 318 as in FIG. 4, but does not extend the length of the closure thread 318 thus providing a large groove or target area 321 for starting the closure 311 on a container. As shown in FIG. 5 the transition area 317*a*, where load bearing thread 317 begins, may be located near the middle of the skirt instead of the open end of closure 211, as in FIG. 4.

Figure 6:
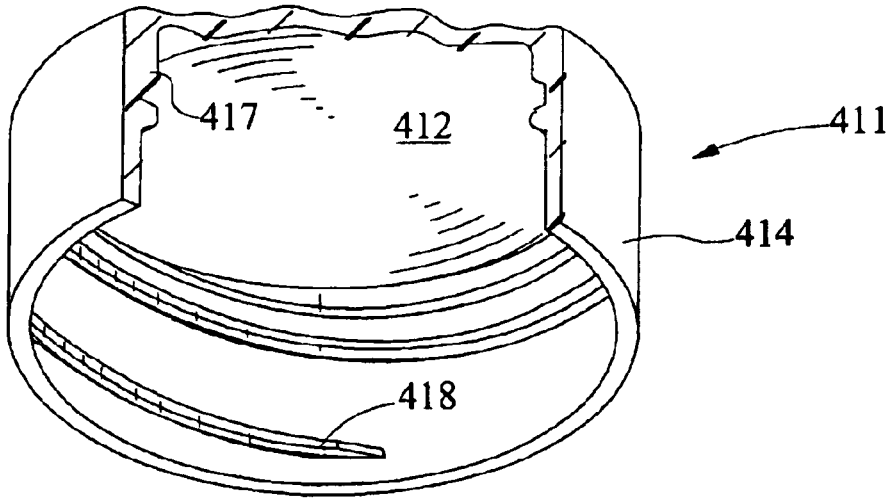
FIG. 6 is a lower perspective view of an alternative embodiment of the present invention having a load bearing thread below the primary thread and, FIG. 7 is a lower perspective view of a closure of the present invention having a plurality of load bearing protuberances which transfer a stacking load from a closure to a container.

FIG. 6 shows another embodiment of a closure 411 having a load bearing thread 417 depending from a top wall 412 at the junction of top wall 412 and skirt 414 and being above a closure thread 418. The load bearing thread 417 and closure thread 418 meet near the top wall 412 forming an area of increased thickness which transfers downward force to a container. In this embodiment the load bearing thread 417 starts from the top wall 412 and helically extends downward along an inner surface of the skirt 414 until it meets the closure thread 418 causing the enlarged area. Thus, FIGS. 4, 5, and 6 show how the transition area can move from an open end of a closure to near the top wall of a closure.

Figure 7:
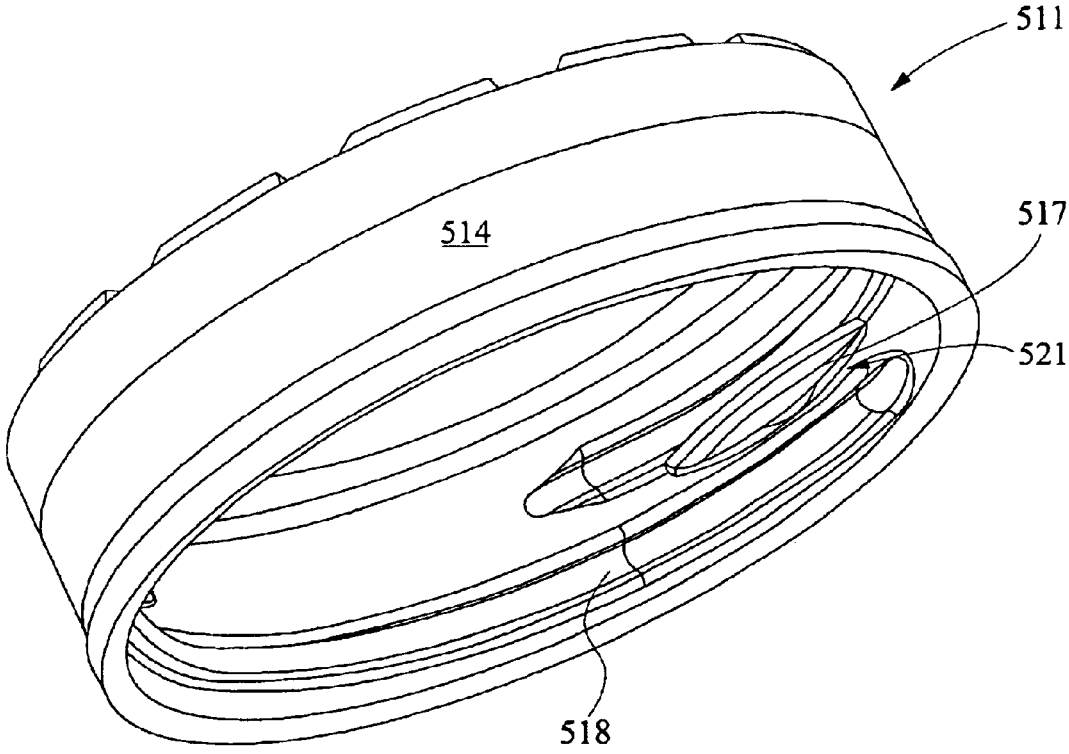

FIG. 7 shows yet another embodiment where at least one load transfer protuberance 517 is integral with a skirt 514 for transferring a stacking load. The protuberance 517 is formed adjacent a closure thread 518 creating a space or groove 521 between the closure thread 518 and the protuberance 517. As the closure 511 is turned onto a container, the closure thread 518 moves beneath a container thread until it is securely fastened. As the closure rotates, the container thread passes above the closure thread 518 and beneath the protuberance 517. By passing the container thread through the groove 521 between the closure thread 518 and protuberance 517 vertical movement between the closure thread 518, container thread, and protuberance 517 is diminished. The result is that a stacking or downward force is transmitted to the container structure preventing damage to the closure gasket.

Preferably, there are three protuberances 517 spaced equidistantly at about 120 degrees apart. However, any number of protuberances 517 may be used to transfer a stacking load to a container depending on the load, size of protuberance, size of closure threads, and the like.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A closure and container finish combination comprising:

an upstanding neck portion;

a primary thread helically extending around said upstanding neck portion;

a load bearing thread interposed between consecutive rotations of said primary thread and helically extending around said upstanding neck portion;

said primary thread and said load bearing thread forming a groove therebetween for rotatably receiving a closure thread;

wherein said load bearing thread includes a connecting thread portion extending from said primary thread.

2. The closure and container finish combination of claim 1, wherein a pitch of a mating closure thread is about twice a vertical distance between said primary thread and said load bearing thread.

3. The closure and container finish combination of claim 1, further comprising a closure having a top wall, a skirt depending therefrom, and a helical thread on an inner surface of said skirt, said closure threadably engaging said container upstanding neck portion.

4. The closure and container finish combination of claim 3, further comprising a sealing gasket on an inner surface of said top wall.

5. The closure and container finish combination of claim 1, wherein said closure thread is of a predefined pitch and wherein said closure is fully removable with a single rotation.

6. A container finish, comprising:

an upstanding neck portion;

a primary thread helically extending around said upstanding neck portion;

a load bearing thread interposed between consecutive rotations of said primary thread and helically extending around said upstanding neck portion;

wherein said load bearing thread starts at a point below a starting point for said primary thread and said load bearing thread is connected to said primary thread by a connecting thread portion;

wherein said connecting thread portion is a horizontal thread portion; and, wherein a pitch of said closure thread is about twice a vertical distance between said primary thread and said load bearing thread.

7. A container finish comprising:

an upstanding neck portion;

a primary thread helically extending around said upstanding neck portion;

a load bearing tread interposed between consecutive rotations of said primary thread and helically extending around said upstanding neck portion;

said primary tread and said load bearing thread forming a groove there between for rotatably receiving a closure thread;

wherein said load bearing thread extends from said primary thread by a connecting thread portion; and, wherein said connecting thread portion is a horizontal thread portion.

8. A load bearing closure finish, comprising:

a top wall having an annular skirt depending from said top wall;

a closure thread extending helically about an inner surface of said annular skirt;

a load bearing thread interposed between consecutive rotations of said closure thread, said load bearing thread extending above said closure thread;

said load bearing thread connected to said closure thread by a thread connecting portion.

9. The load bearing closure finish of claim 8, said thread connecting portion being substantially horizontal.

* * * * *